United States Patent [19]

Suprise et al.

[11] Patent Number: 4,646,365

[45] Date of Patent: Mar. 3, 1987

[54] DISPOSABLE BIB WITH AN INTEGRAL, ELASTICIZED NECKBAND

[75] Inventors: Jody D. Suprise, Neenah; Paul T. Van Gompel, Hortonville, both of Wis.

[73] Assignee: Kimberly-Clark Corporation, Neenah, Wis.

[21] Appl. No.: 887,571

[22] Filed: Jul. 16, 1986

[51] Int. Cl.[4] ..... A41B 13/10

[52] U.S. Cl. ..... 2/49 R; 2/51

[58] Field of Search ..... 2/48, 49, 50, 51

[56] References Cited

U.S. PATENT DOCUMENTS

| | | | |
|---|---|---|---|
| 2,174,694 | 10/1939 | Elson | 2/49 |
| 2,367,383 | 1/1945 | Tiscornia | 2/49 |
| 2,571,888 | 10/1951 | Jesse | 2/49 |
| 2,835,895 | 5/1958 | Wells | 2/49 R |
| 2,881,447 | 4/1959 | Shackelford | 2/49 R |
| 3,146,465 | 9/1964 | Hummel | 2/49 |
| 3,793,644 | 2/1974 | Kellner | 2/49 |
| 3,995,321 | 12/1976 | Johnson | 2/49 |
| 3,999,221 | 12/1976 | Hannigan | 2/49 |
| 4,416,025 | 11/1983 | Moret et al. | 2/49 |
| 4,441,212 | 4/1984 | Ahr et al. | 2/49 |
| 4,445,231 | 5/1984 | Noel | 2/49 |
| 4,475,250 | 10/1984 | Savin et al. | 2/49 |
| 4,495,658 | 1/1985 | Moret et al. | 2/49 |

FOREIGN PATENT DOCUMENTS 1463863 2/1977 United Kingdom .

*Primary Examiner*—Doris L. Troutman
*Attorney, Agent, or Firm*—Paul Yee

[57] ABSTRACT

The present invention provides a protective garment which comprises a base sheet member having a neck opening formed in a selected neckband section thereof. A layer of elastomeric material is bonded and laminated to at least a portion of the neckband section to provide an elastic strap which spans across the neck opening.

17 Claims, 4 Drawing Figures

DISPOSABLE BIB WITH AN INTEGRAL, ELASTICIZED NECKBAND

FIELD OF THE INVENTION

The present invention pertains to protective garments, such as disposable bibs for infants. More particularly, the present invention pertains to a protective bib garment having a distinctive elasticized neckband which more effectively holds a garment on a wearer and provides a closer fit around the wearer's neck.

BACKGROUND OF THE INVENTION

The catcher pockets employed with conventional protective bibs have not readily remained open. As a result, various bib configurations have been developed to help hold open the bib pocket. For example, U.S. Pat. No. 3,995,321 issued Dec. 7, 1976 to S. Johnson discloses a bib which includes adhesive tabs designed to attach the front lip of the pocket to the edge of a table, thereby holding the bib pocket open. Other bib designs have employed a depending apron which is connected to the front lip of the bib pocket and which is configured to gravitationally open the pocket and hold it open. For example, see U.S. Pat. No. 4,495,658 issued Jan. 29, 1965 to D. Moret, et al.; U.S. Pat. No. 4,445,231 issued May 1, 1984 to J. Noel; U.S. Pat. No. 4,441,212 issued Apr. 10, 1984 to N. Ahr, et al.; and U.S. Pat. No. 4,416,025 issued Nov. 22, 1983 to D. Moret, et al.

Bib configurations have also employed side gusset members to help hold the bib pocket open. For example, see British Pat. No. 1,463,863 published Feb. 9, 1977 with K. Andersson as the listed inventor; and U.S. Pat. No. 2,367,383 issued Jan. 16, 1945 to J. Tiscornia.

To hold the garment on a wearer, conventional bibs have typically employed tie straps having various configurations. Examples of such tie straps are shown in U.S. Pat. No. 4,475,250 issued Oct. 9, 1984 to B. Savin, et al.; U.S. Pat. No. 3,793,644 issued Feb. 26, 1974 to I. Kellner; U.S. Pat. No. 3,999,221 issued Dec. 28, 1976 to L. Hannigan; U.S. Pat. No. 3,146,465 issued Sep. 1, 1964 to R. Hummel; and U.S. Pat. No. 2,174,694 issued Oct. 3, 1939 to A. Elson. A disposable baby bib employing an elastic strip having spring clips at its opposite ends is described in U.S. Pat. No. 2,571,888 issued Oct. 16, 1951 to K. Jesse.

Conventional protective bib garments, such as those described above, have not been completely satisfactory. The bib garments have not provided a sufficiently reliable and convenient mechanism for holding the catcher pocket open. For example, the bib configurations which attach a part of the bib to a piece of furniture can undesirably limit the movement of the wearer and can put excessive stresses on the bib structure. In addition, the securing straps employed by conventional bib configurations are often cumbersome to tie and can undesirably loosen during use.

BRIEF DESCRIPTION OF THE INVENTION

The present invention provides an improved protective garment, which includes a base sheet member having an opening formed in a selected neckband section thereof. A layer of elastomeric film is bonded and laminated to at least a portion of the neckband section to provide an elastic strap.

The present invention further provides a distinctive method for forming a protective garment. The method includes the step of providing a base sheet member which has a neck opening formed in a selected neckband section thereof. A layer of elastomeric material is laminated to at least a portion of the neckband section to provide an elastic strap which spans across the neck opening.

The distinctive garment of the invention can advantageously provide an improved and more effective mechanism for securing the protective garment around the neck of a wearer. The elasticized neckband region of the garment is generally self-adjusting and can provide a closer fit around the wearer's neck.

BRIEF DESCRIPTION OF THE DRAWINGS

The invention will be more fully understood and further advantages will become apparent when reference is made to the following detailed description of the invention and the drawings, in which.

DETAILED DESCRIPTION OF THE INVENTION

The following detailed description of the invention is made in the context of a protective bib garment. However, it will be readily apparent to a person having ordinary skill in the art that the structures of the present invention can be incorporated into other protective garments, such as aprons, gowns and the like.

Figure 1:
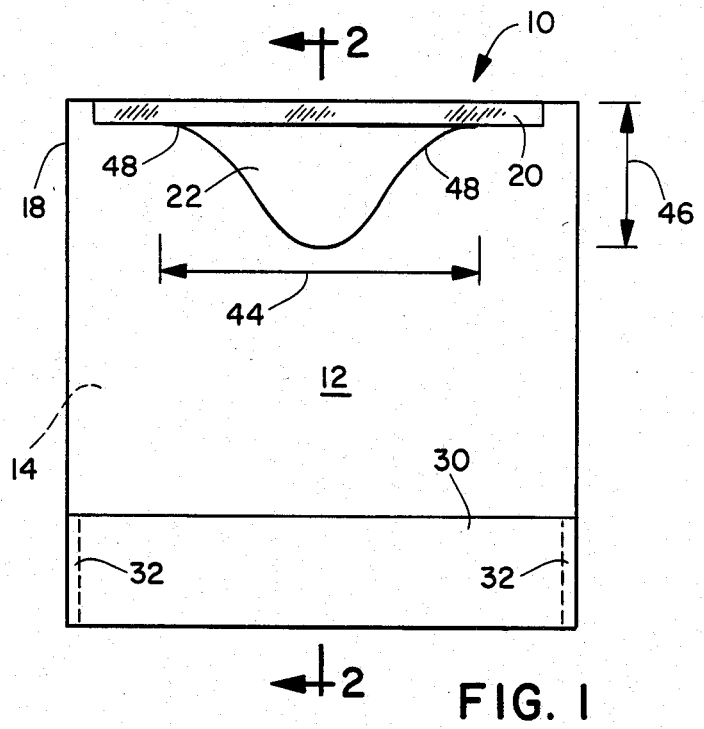
FIG. 1 shows a plan view of a representative bib garment of the invention.
Figure 2:
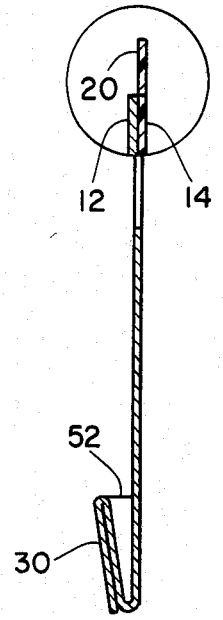
FIG. 2 representatively shows a partially magnified cross-sectional view of the protective garment shown in FIG. 1. taken along line 2—2.

Referring now to FIGS. 1 and 2, a representative protective garment, such as bib 10, includes a base sheet member 12 which has a neck opening 22 formed in a selected neckband section 18 thereof. A layer of extruded elastomeric film material 14 is laminated to at least a portion of the neckband section to provide an elastic strap 20. In a particular aspect of the invention, bib 10 can further comprise a catcher member 30 connected in an adjacent, facing relation to a selected portion of base sheet member 12 to form a catcher pouch 52 which opens toward a generally upward direction.

In the illustrated embodiment, base sheet member 12 is generally rectangular in planform. However, it will be readily apparent that various other types of planforms, such as trapezoidal and oval planforms, may also be employed with equivalent effect. In particular embodiments of the invention, base sheet 12 comprises a cloth-like, fibrous nonwoven material, such as a thermally bonded polypropylene staple fiber or a spunbonded polypropylene filaments. Other suitable materials include, for example, thermally bonded polyesters, blends of polypropylene and polyester, and blends of polypropylene, polyester, cotton, rayon, chisso, and the like. In particularly preferred embodiments, base sheet 12 is composed of materials which exhibit some degree of absorbency. Such materials can absorb spilled liquids and reduce the amount of liquid run off that might otherwise soil the clothing of the wearer.

A suitable neck opening 22 is formed into a selected neckband section 18 of base sheet 12. The neck opening can have various contoured outlines, such as a rectilinear or arcuate outline contour. In the illustrated embodiment, for example, the neck opening has a generally crescent-shaped outline. More particularly, the oppositely disposed transversely located edges of the neck opening are rounded or tailed off to produce an inverted-bell shaped outline.

An elastic film layer 14 is positioned in facing relation with base sheet 12, and is suitably bonded to the base sheet to provide a laminated structure. In a preferred aspect of the invention, elastic film layer 14 is extruded directly onto base sheet 12 employing conventional techniques.

The elastic film layer is a polymeric, thermoplastic film material. Suitable elastomeric film materials include, for example, polymers of polypropylene, ethylene, copolymers of ethylene block copolymers of butadiene isoprene and styrene, and compatible copolymers of two or more acrylate films. In a particularly preferred embodiment of the invention, the protective garment comprises an ethylene-methylacrylate film laminated onto a base sheet composed of nonwoven polypropylene fiber material.

To provide improved effectiveness, the elastomeric material should be capable of providing an elastic extensibility of at least about 50%. This elastic extensibility is determined by the formula, $$(L_2-L_1)/L_1;$$

wherein:

$L_1$ is the relaxed, contracted length of the elastomeric material; and $L_2$ is the maximum elongated length of the elastomeric material. To further improve the effectiveness and comfort of the garment, the elastomeric material has a modulus of about 60–140 psi (45–104 KPa), and preferably has a modulus of about 90–110 psi (67–82 KPa). This modulus is measured on a sample which is 13 cm in length and is stretched to an elongation of 200%.

Elastomeric film layer 14 covers at least a portion of the neckband section 18 of base sheet 12, and a portion of the elastomeric layer is constructed and arranged to substantially span across the open, "mouth" region of neck opening 22. In a preferred aspect of the invention, the elastic film layer covers substantially an entire major surface of base sheet 12. Thusly configured, the elastic film layer can provide a substantially liquid impermeable barrier layer which can help keep spilled liquids away from the clothing of the wearer. To provide improved effectiveness, the elastic film layer 14 is located and positioned to provide an appointed body facing surface of the garment. Base sheet 12 would then form the outward facing surface of the garment.

If necessary, one or more selected sections of the spanning portion of the elastomeric film layer 14 are separated from the other remaining areas of the elastomeric layer to provide the elastic strap which spans across the neck opening 22. For example, in the illustrated embodiment, a selected medial portion of the elastic film layer positioned within neck opening 22 is removed. The removed portion of the elastic film layer has an edge contour which extends substantially along the edge outline of neck opening 22, but has an extent along the garment length dimension which is less than the lengthwise extent of neck opening 22. As a result, there is a remaining section of elastic film material which is configured to form an elastic strap 20. The elastic strap spans across neck opening 22 in a transverse direction and can be suitably stretched to allow the placement of the garment over the head of a wearer. The stretched strap can then elastically contract to hold the garment in a closely fitting position around the wearer's neck. This close fit advantageously reduces any gap between the bib outline and the wearer's neck and reduces the probability that spilled materials might fall through the gap onto the wearer's clothing.

In particular aspects of the invention, the transverse extent 44 of neck opening 22 ranges from about 4–12 inches (about 10–30 cm), and preferably measures about 9 inches (23 cm). The depth 46 of neck opening 22 ranges from about 2–6 inches (about 5–15 cm) and preferably measures about 3 inches (about 8 cm). In a particularly preferred embodiment, neck opening 22 has a bell-shaped, curved outline contour which includes tapered tails 48 at each transverse end thereof. Each of the tapered tails extends transversely about 1–4 inches (about 2.5–10 cm) and preferably extends about 1.5 inches (about 3.7 cm). Tapered tails 48 can advantageously allow a greater extension of the elasticized neck strap 20 without increasing the effective size of neck opening 22, while still maintaining a close fit to the neck of the wearer.

Figure 3:
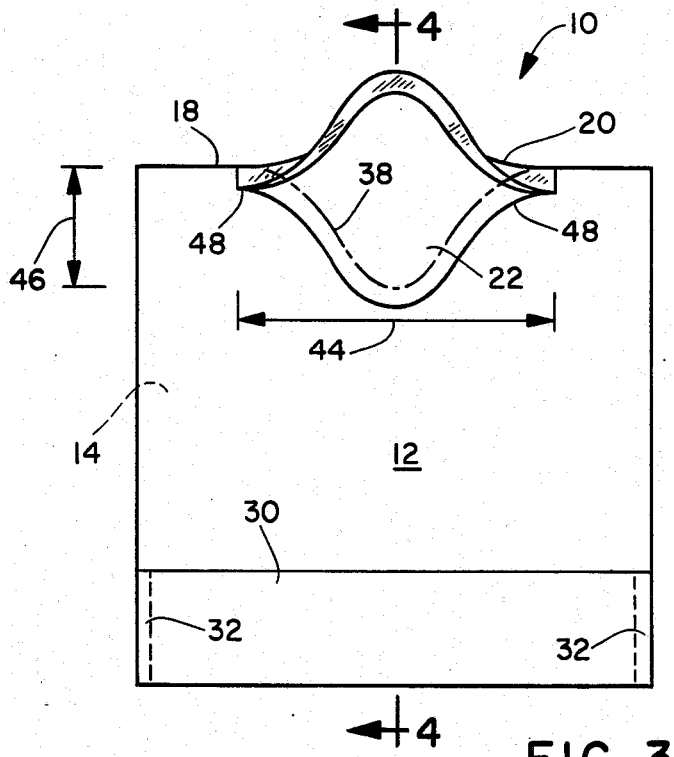
FIG. 3 representatively shows a plan view of another embodiment of the protective garment of the invention.

In a further aspect of the invention, the portion of elastic film layer 14 which spans across neck opening 22 is cut away along a separation line 38, as representatively shown by a dotted line in FIG. 3. Separation line 38 extends in a generally uniform spaced registry with the outline contour of neck opening 22, and is spaced a selected strap width distance away from the neck opening outline. A second contoured cut is then made in the elastic film layer generally adjacent to and along at least a portion of the outline of neck opening 22. This cut defines and releases a neck strap which is composed of the elastic film material and is located in a generally adjacent registry with the outline contour of neck opening 22. The elastic strap remains connected to base sheet 12 at its laterally positioned ends, and can be stretched to fit the garment over the wearer's head.

If desired, a catcher member 30 can be connected in facing relation with a selected portion of base sheet 12 and arranged to span across the transverse width of the base sheet. The bottom and side edges of the catcher member are suitably attached to base sheet 12 to form a catcher pouch. During use, this catcher pouch opens toward a generally upward direction.

Figure 4:
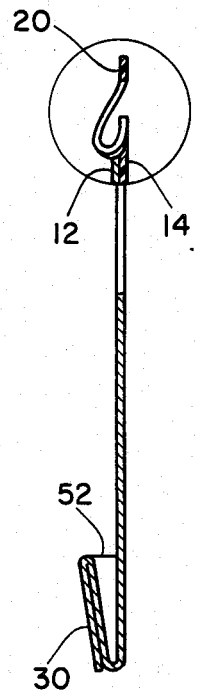
FIG. 4 shows a partially magnified cross-sectional view of the protective garment shown in FIG. 3 taken along line 4—4.

In an alternative arrangement, catcher member 30 is formed by folding a longitudinal end portion of base sheet 12. The folded-up portion is then connected to the main base sheet member with suitable side edge attachment means 32. These side edge attachment means may, for example, comprise sonic bonds or adhesive bonds. In yet another alternative arrangement, a longitudinal end portion of base sheet 12 can be double-folded, as illustrated in FIG. 4 to form catcher member 30. With this arrangement, the cloth-like material of base sheet 12 forms an outward facing surface of the catcher member and presents a more pleasing appearance.

The following example is given to provide a more detailed understanding of the invention. The particular measurements, compositions, and parameters set forth in the example are exemplary and are not intended to specifically limit the invention.

EXAMPLE

A base sheet 12 was composed of thermally bonded polypropylene, bonded carded web and measured 35.5×45.7 cm. A bell-shaped opening was formed into the neckband section of the base sheet and had a total transverse extent of about 23 cm. The depth of neck opening 22 measured about 8 cm. An elastic film layer composed of ethylene-methylacrylate was extruded onto base sheet 12 and had a thickness of about 0.085 cm. The elastic film layer covered substantially the entire surface of base sheet 12 and spanned across neck opening 22. A bell-shaped portion of the elastic film layer crossing the neck opening was then cut away to leave a remaining elastic film layer section which formed neck strap 20.

A catcher pouch was formed by double folding one longitudinal end of base sheet 12 to form a catcher member. The lateral side edges of the catcher member were then adhesively attached to the main base sheet 12 to form the catcher pouch. The catcher member was constructed and arranged to provide a pouch depth of about 8 cm.

Having thus described the invention in rather full detail, it will be readily apparent to a person having ordinary skill in the art that various changes and modifications can be made without departing from the spirit of the invention. All of such changes and modifications are contemplated as being within the scope of the present invention, as defined by the subjoined claims.

We claim:

1. A protective garment, comprising:

a. a base sheet member which has a neck opening formed in a selected neckband section thereof; and b. a layer of elastomeric material which is laminated to at least a portion of said neckband section to provide an elastic strap which spans across said neck opening.

2. A protective garment as recited in claim 1, wherein said layer of elastomeric material covers substantially an entire major surface of said base sheet member.

3. A protective garment as recited in claim 2, wherein said elastomeric layer is substantially liquid impermeable.

4. A protective garment as recited in claim 1, wherein said layer of elastomeric material is extruded onto said base sheet member.

5. A protective garment as recited in claim 2, wherein said layer of elastomeric material is extruded onto said base sheet member.

6. A protective garment as recited in claim 3, wherein said layer of elastomeric material is extruded onto said base sheet member.

7. A protective garment as recited in claim 1, wherein said neck opening has a crescent-shaped outline.

8. A protective garment as recited in claim 1, wherein said neck opening in said base sheet member has a bell-shaped outline.

9. A protective garment as recited in claim 1, further comprising a catcher member connected to a selected portion of said base sheet member to form a catcher pouch.

10. A garment as recited in claim 9, wherein said catcher pouch comprises a double-folded longitudinal end portion of said base sheet member.

11. A protective garment as recited in claim 1, wherein said elastic strap has an elastic extensibility of at least about 50%.

12. A garment as recited in claim 1, wherein said base sheet member is composed of an absorbent material.

13. A garment as recited in claim 1, wherein said elastic strap comprises a section of elastic material which remains after a removal of a selected medial portion of said elastomeric layer from said neck opening.

14. A garment as recited in claim 1, wherein said elastic strap comprises a layer of elastic material located in a generally adjacent registry with an outline contour of said neck opening.

15. A method for forming a protective garment, comprising the steps of:

a. providing a base sheet member which has a neck opening formed in a selected neckband section thereof; and b. laminating a layer of elastomeric material to at least a portion of said neckband section to provide an elastic strap which spans across said neck opening.

16. A method for forming a protective garment, comprising the steps of:

a. providing a base sheet member which has a neck opening formed in a selected neckband section thereof;

b. laminating a layer of elastomeric material to at least a portion of said neckband section in a configuration which spans a portion of said elastomeric layer across said neck opening; and c. separating one or more selected sections of said spanning portion of the elastomeric layer from the remainder thereof to provide an elastic strap which spans across said neck opening.

17. A method as recited in claim 16, wherein said separating step (c) includes the step of removing a crescent-shaped section from said spanning portion of the elastomeric layer.

* * * * *